US006591534B1

(12) United States Patent
Trudeau et al.

(10) Patent No.: US 6,591,534 B1
(45) Date of Patent: Jul. 15, 2003

(54) GUN LOCKING INTERFACE ASSEMBLY FOR NON-CONFORMING COMPONENTS

(75) Inventors: Donald Trudeau, Troy, NY (US); Michael S. Soja, Castleton, NY (US); Michael D. Gully, Waterford, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 365 days.

(21) Appl. No.: 09/651,230

(22) Filed: Aug. 25, 2000

(51) Int. Cl.[7] ..... F41A 21/00

(52) U.S. Cl. ..... 42/75.02; 42/77; 89/14.05; 89/29

(58) Field of Search ..... 42/75.02, 77; 89/14.05, 89/29

(56) References Cited

U.S. PATENT DOCUMENTS 3,849,925 A * 11/1974 Mayer
3,877,167 A * 4/1975 Keppeler
4,638,714 A * 1/1987 Heintz et al.
4,726,280 A * 2/1988 Frye
5,239,767 A * 8/1993 Briley, Jr. et al.
5,650,586 A * 7/1997 Balbo et al.
6,250,198 B1 * 6/2001 Vendetti et al.
6,318,230 B1 * 11/2001 Bamber

FOREIGN PATENT DOCUMENTS

CH 204889 * 3/1938
DE 003915410 A * 11/1990

* cited by examiner

*Primary Examiner*—Michael J. Carone
*Assistant Examiner*—John Richardson
(74) *Attorney, Agent, or Firm*—Michael C. Sachs; John F. Moran

(57) ABSTRACT

Shown is a locking interface assembly that facilitates the integration of a commercial Long Gun Barrel tube with an existing gun mount of a conventional Tank. The interface assembly allows the non-conforming tube to be fitted to the mount in a precise fashion, eliminating clearances between the mount and tube, permitting re-tightening of elements that become loose during high inertial loadings. The interface assembly is comprised of a thrust nut, bearing, retaining ring, king nut, adapter, pin, nut key, locking pin, retainer pin, retaining ring key, key retainer pin and screw. The retaining ring is slid over the tube, followed by the a coupling subassembly comprised of the bearing and the thrust nut. The coupling subassembly engages the tube shoulder to prevent the bearing from rotating. The king nut engages the tube to capture the bearing against the tube shoulder and to prevent the bearing from moving with respect thereto. An adapter engages the internal shoulder of the bearing and is pressed against the tube, with the retaining ring engaging the internal threads of the bearing to produce an axial motion that drives the tapered end of the retaining ring across a matching taper of the adapter.

3 Claims, 7 Drawing Sheets

GUN LOCKING INTERFACE ASSEMBLY FOR NON-CONFORMING COMPONENTS

GOVERNMENT INTEREST

The invention described herein may be manufactured and used by or for the Government of the United States for governmental purposes.

FIELD OF THE INVENTION

The present invention relates to the field of artillery, and particularly to a system upgrade to a gun or cannon. More specifically, the present invention relates to a locking interface assembly that facilitates the integration of a commercially available Long Gun Barrel tube with existing gun mounts for conventional Tanks.

BACKGROUND OF THE INVENTION

The M1 Abrams tank is a main battle tank of the U.S. Army that is widely recognized as a pre-eminent armored vehicle currently available. However, the incorporation of accessories to the M1 Abrams tank can cause several problems, among which are the following:

1. Adapting a tube with a non-standard/non-conforming tube outer diameter to a conventional mounting receptacle on an Abrams tank or, more generally, a mobile armored vehicle, is a difficulty. In one particular example, a Long Gun Barrel tube currently sold through Rheinmetall GmbH, has a larger outside diameter than an Abrams mounting receptacle. A solution to this problem requires a method of joining the cannon barrel to the gun mount such that clearances and/or tolerance build-ups in the component parts do not affect the accuracy of the fit between the mount and the cannon barrel. Accuracy of the fit between the barrel and the mount ultimately affects the accuracy of the gun.

2. Incorporating a method of joining the cannon barrel (tube) to the gun mount in a manner that prevents relative axial motion (and accompanying reduction in accuracy) during firing.

3. Incorporating a means of re-tightening and re-locking components of the interface assembly in the event that they loosen after extended periods of firing. It would therefore be desirable to have a new locking mechanism that eliminates the need for machining holes for locking set screws.

4. Replacement of a coupler whose design could not be adapted to the Long Gun Barrel, is a difficulty. It would therefore be desirable to have a new coupler with a flexible multi-element design.

SUMMARY OF THE INVENTION

One feature of the present invention is to upgrade the Abrams by incorporating a new gun barrel. Specifically, the interface assembly facilitates the integration of the commercial Long Gun Barrel tube with an existing gun mount of the Abrams Tank. This invention permits a non-conforming tube configuration (Long Gun Barrel tube) to be incorporated onto the gun mount of the Abrams tank in a secure manner, such that it achieves and maintains superior accuracy when the tank is firing its gun during protracted operation and while on the move.

Another feature of the present invention is an attachment interface assembly that achieves zero (or almost zero) clearance between the tube and the mount bearing, thus preventing relative axial motion during firing.

Furthermore, the present invention allows key components of the coupler to be re-tightened and re-locked following multiple firings, thus maintaining the accuracy of the gun and avoiding safety issues.

The foregoing and other features of the present invention are realized by a multi-element interface assembly design that allows the non-conforming tube to be fitted to the mount in a precise fashion, eliminating clearances between the mount and tube, permitting re-tightening of elements that become loose during high inertial loadings. The interface assembly is comprised of a thrust nut, bearing, retaining ring, king nut, adapter, pin, nut key, locking pin, retainer pin, retaining ring key, key retainer pin and screw. It can be appreciated that the present design of the interface assembly includes a minimal number of components to achieve the advantages described herein.

The interface assembly is assembled from its constituent parts in the following manner: A retaining ring is slid over the muzzle end of the tube and is moved to an axial location on the breech side of the tube shoulder of the Long Barrel Gun tube. The tapered end of the retaining ring faces the muzzle end of as the tube. A coupling subassembly, formed of the combination of the thrust nut, bearing and two pins inserted into radial holes in the bearing, is slid over the muzzle end of the tube and seated against the tube shoulder.

Once rotated into place, the pins engage corresponding notches in the tube shoulder and prevent rotation of the bearing. With the coupling subassembly now held in place against the tube shoulder, the king nut is slid over the muzzle end of the tube and tightened on integral screw threads on the outer diameter of the tube, capturing the bearing between the tube shoulder and the face of the king nut. It should be appreciated that that the thrust nut, threaded onto the outer diameter of the bearing is still free to rotate.

With proper torquing and alignment and the addition of a locking mechanism comprising a nut key and screw, the king nut is interlocked to the bearing. The thrust nut can no longer rotate and the bearing is prevented from moving axially or rotationally with respect to the tube shoulder.

Continuing the assembly of the interface assembly assembly, the two halves of the clam-shelled adapter, incorporating serrated fingers and a tapered cross-section, are then inserted into the bore of the bearing, previously attached to the tube as part of the coupling subassembly described above. The clam-shelled design of the adapter allows it to fit tightly against the tube and obviates the need to slide an otherwise oversized component past the tube shoulder.

The adapter, inserted from the bore side of the tube, is seated against the internal shoulder of the bearing. At this point the retaining ring, previously installed on the tube, is slid axially along the tube until it engages the internal threads of the bearing. Threading the retaining ring into the fixed bearing produces an axial motion that drives the tapered section of the retaining ring across the matching taper of the adapter.

The tapered section of the bearing initially expands as it encounters the taper of the adapter. However, the inner diameter of bearing limits and then precludes outward radial expansion of tapered region of retaining ring as retaining ring continues to rotate and advance axially. With the outward expansion of the bearing inhibited, the wedging effect produced by the relative axial motion of the two tapered sections results an inward radial force on the serrated fingers of this adapter. The inward force applied to the serrated fingers of the adapter provides a uniform circumferential clamping force on the serrated fingers. The fingers distort inward and clamp down on the outer diameter the tube.

The tube is now clamped by the serrated fingers in an axial position located between the breech and the tube shoulder, providing additional stability to the interface assembly assembly. In addition, the design provides zero clearance between the tube and bearing as the opposing tapered sectioning fill the interstitial space between the outer diameter of the tube and the inner diameter of the bearing. It should be appreciated that the use of serrated fingers in the design of adapter prevents buckling of adapter as its inner diameter reduces to match, and ultimately clamp onto, the outer diameter of the tube as the retaining ring is torqued to a specified value.

A locking mechanism, composed of a key retainer pin and screw are now added. These components prevent subsequent loosening of retaining ring and adapter by interlocking the threaded retaining ring to the bearing. At this point the tube with the affixed interface assembly is ready to be assembled to the gun mount.

Using a near-standard U.S. Army assembly procedure the tube/interface assembly is assembled to the gun-mount, the thrust nut, previously threaded onto the outer diameter of the bearing advanced against the mount piston. The thrust nut is torqued to approximately 1000 ft-lbs, capturing the (mount) piston between the interface assembly and the cannon breech mechanism. The final step of the gun barrel assembly is to add a locking mechanism formed by a locking pin/retaining pin combination.

The thrust nut is advanced to align its notch with the locking pin hole in the previously installed nut key. The locking pin is threaded into the nut key pin hole until it bottoms out. In is then backed out slightly until the retainer pin can be inserted. The retainer pin is threaded in until tight and then staked to prevent it from backing out. This capture mechanism eliminates all built-up clearances and provides a tight mount assembly, necessary for system accuracy.

The assembly described above eliminates most interface problems between the gun mount and a non-conforming gun barrel on an Abrams tank. The front pilot diameter of bearing when assembled on tube provides a tight circumferential interface assembly. Pins inserted in the bearing and aligned with notches in tube shoulder prevent axial and rotational motion of bearing with respect to the tube while king nut is tightened and ultimately contribute to the stability of the interface assembly assembly. Threading the king nut into place and locking with nut key fixes bearing with installed pins against the tube shoulder, eliminates subsequent axial or rotational motion between the bearing and the tube shoulder. Relative axial motion is substantially reduced even under high g-loadings such as multiple discharges of the tank's main gun and/or high speed travel of the vehicle over rough terrain.

When the adapter is installed, the retaining ring serves two purposes. The first is to retain the adapter. The second is to compress the serrated fingers of the adapter onto the outer diameter of tube as the tapers of retaining ring and adapter come in contact and move across one another. The inner diameter of bearing limits and eventually precludes radial expansion of tapered region of retaining ring as retaining ring advances axially. Thus, a compressive force generated by the relative axial motion of the tapers and directed radially inward, results in a uniform distortion of the serrated fingers of the adapter.

The relative axial movement of the two tapered regions produces a wedging effect that eliminates clearances between the tube, adapter and bearing, and assures a uniform, high quality interference fit between the tube and adapter.

The use of the serrated fingers in the design of adapter prevents buckling of Adapter as its inner diameter reduces to match, and ultimately clamp onto, outer diameter of tube.

The two-piece design of the adapter permits ready installation over tube and allows a tight initial fit between the inner diameter of adapter and outer diameter of tube, thus minimizing the amount of distortion required of serrated fingers to achieve a circumferential clamp.

The assembly formed by key retainer pin and key retaking screw locks the retaining ring and adapter in place and interlocks the retaining ring to the bearing. The unique design obviates the need for set screws or additional machined holes. The locking mechanism formed by nut key, thrust nut locking pin, and screw locks the king nut in place without the need for set screws or additional machined holes.

The addition of the locking pin into the nut key and the insertion of a staked retaining pin completes the assembly to the gun mount and serves as a final locking mechanism, again avoiding the need for set screws or additional machined holes. In the event that components of the interface assembly need to be re-tightened, this is readily accomplished by removing the appropriate locking mechanism, retightening and re-installing the locking mechanism. All the components are self-locking or are provided with accompanying key-type hardware that provides a locking function. Threads are staked to eliminate the possibility of loosening or backing out.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items:

DETAILED DESCRIPTION OF THE INVENTION

Figure 1:
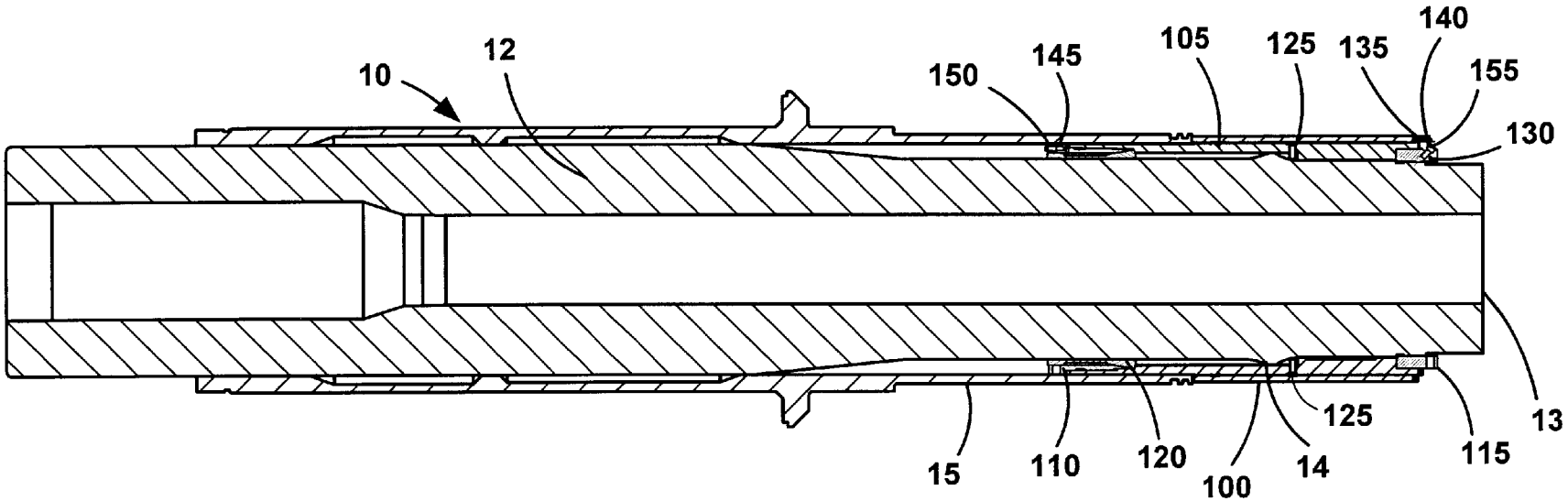
FIG. 1 is a view of a non-conforming tube affixed to an existing gun mount of the Abrams tank, illustrating the major components of a multi-element interface assembly of the present invention.
Figure 2:
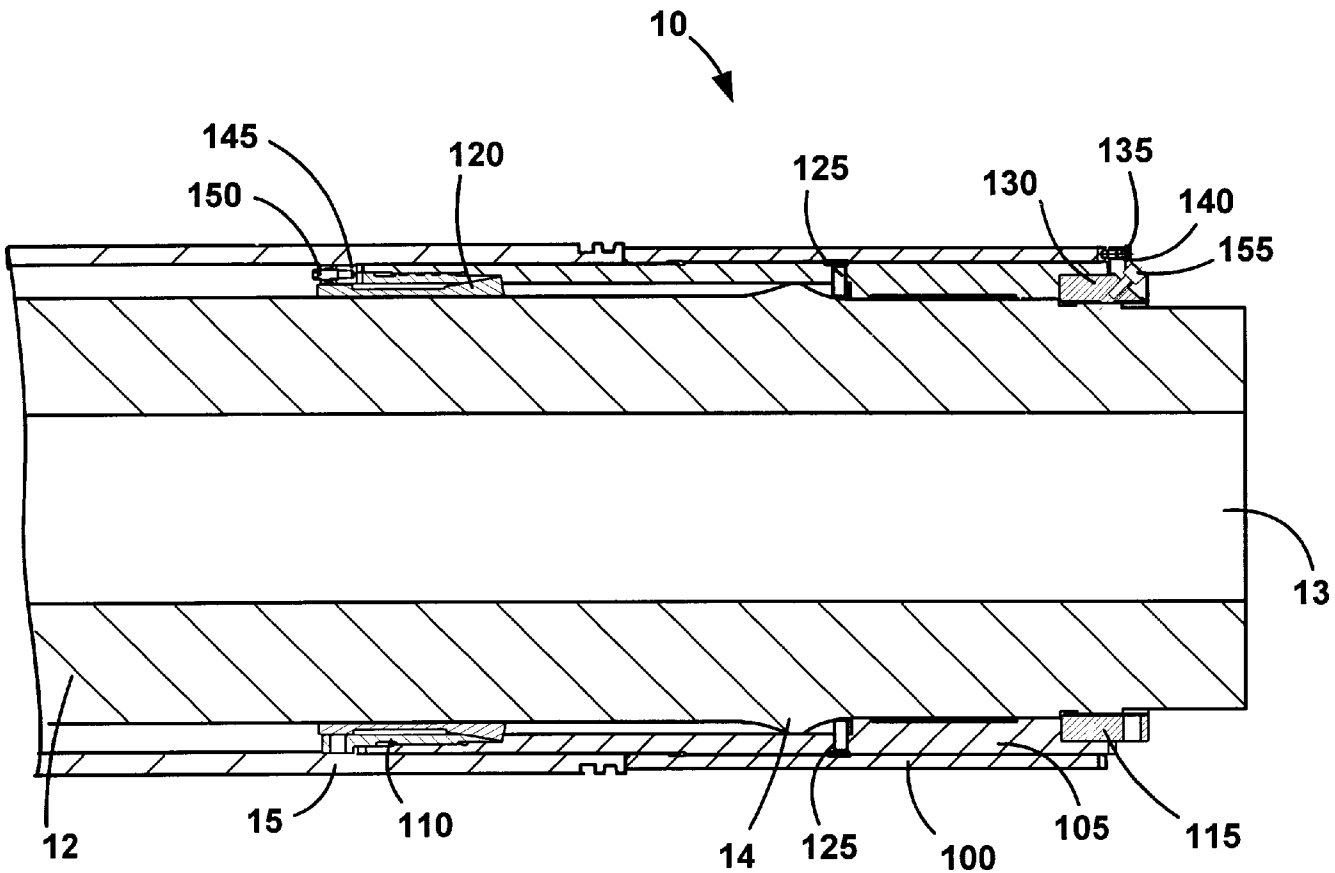
FIG. 2 is an enlarged, cross-sectional, partial view of the assembled interface assembly of FIG. 1, showing its major attributes, including its multi-element nature, evidence of zero clearance between the interface assembly and the tube, and its self-locking features.
Figure 3:
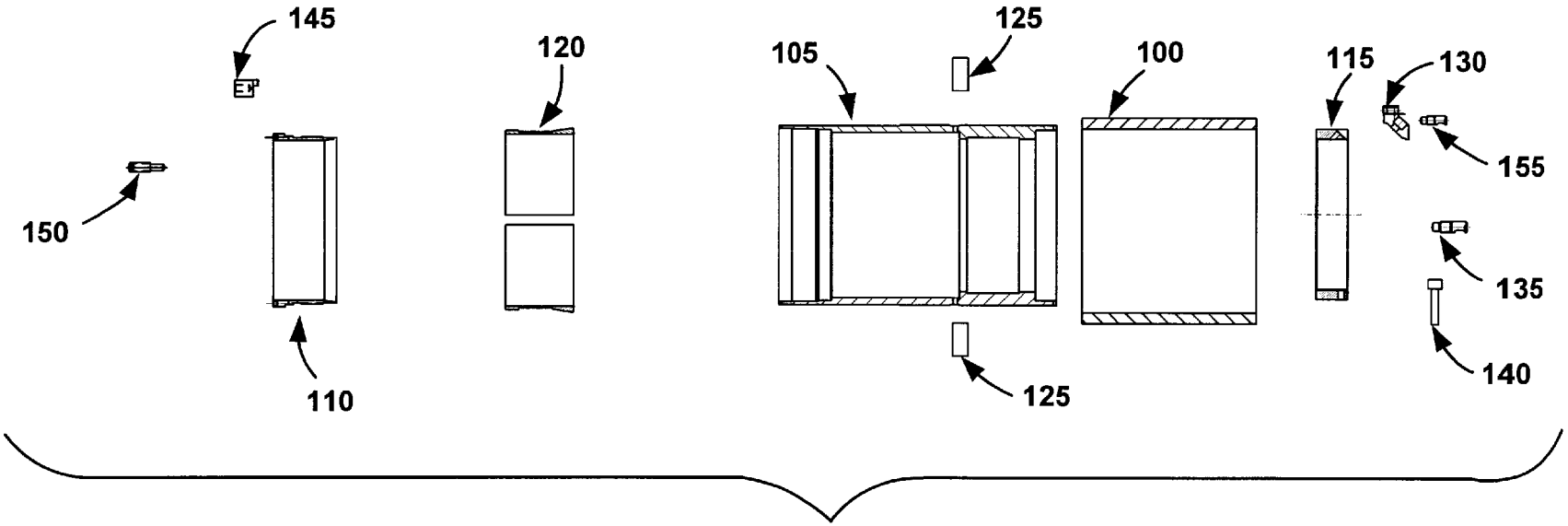
FIG. 3 is an exploded view of the interface assembly of FIG. 1, with smaller components shown enlarged and not to scale for clarity of illustration.

FIG. 1 illustrates an interface assembly 10 according to the present invention that interlocks a tube 12 to a gun mount. The interface assembly 10 includes the following components: a thrust nut 100, a bearing 105, a retaining ring 110, a locking mechanism including a king nut 115, an adapter 120, two pins 125, a nut key 130, a locking pin 135, a retainer pin 140, a retaining ring key 145, a key retainer pin 150, and a screw 155. FIG. 2 provides a detailed view of the assembled interface assembly 10, mounted on a non-conforming tube 12. FIG. 3 provides an exploded view of the individual components comprising the interface assembly 10.

Figure 4:
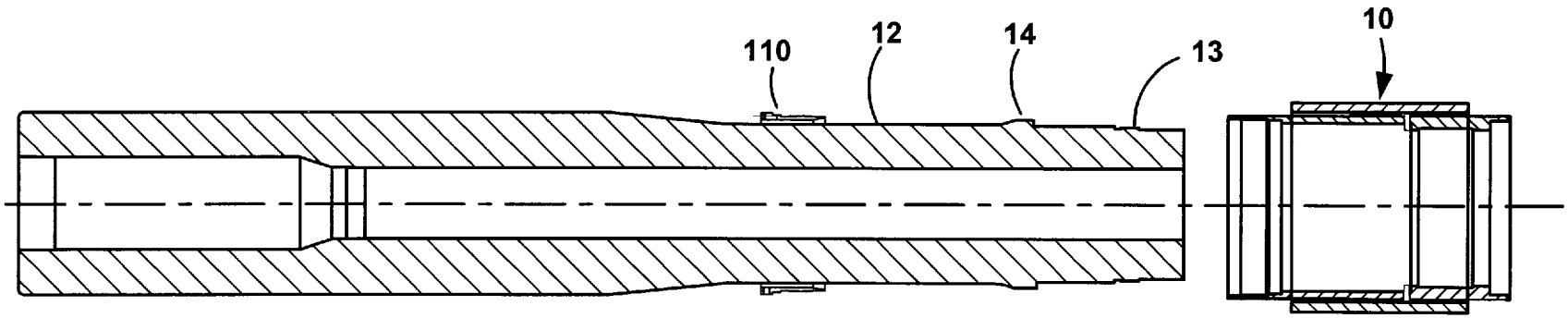
FIG. 4 is a side elevational cross-sectional view of the retaining ring, tube, and thrust nut/bearing assembly formed of the combination of the bearing, thrust nut and pins of the interface assembly of FIG. 1.

With further reference to FIG. 4, the interface assembly 10 is assembled to the tube 12 by sliding the retaining ring 110 over the muzzle end 13 of the tube 12. The ring 110 is then positioned in an axial location on the breech side of the shoulder 14 of the tube 12. The tapered, threaded end of the ring 110 faces the tube shoulder 14.

Figure 5:
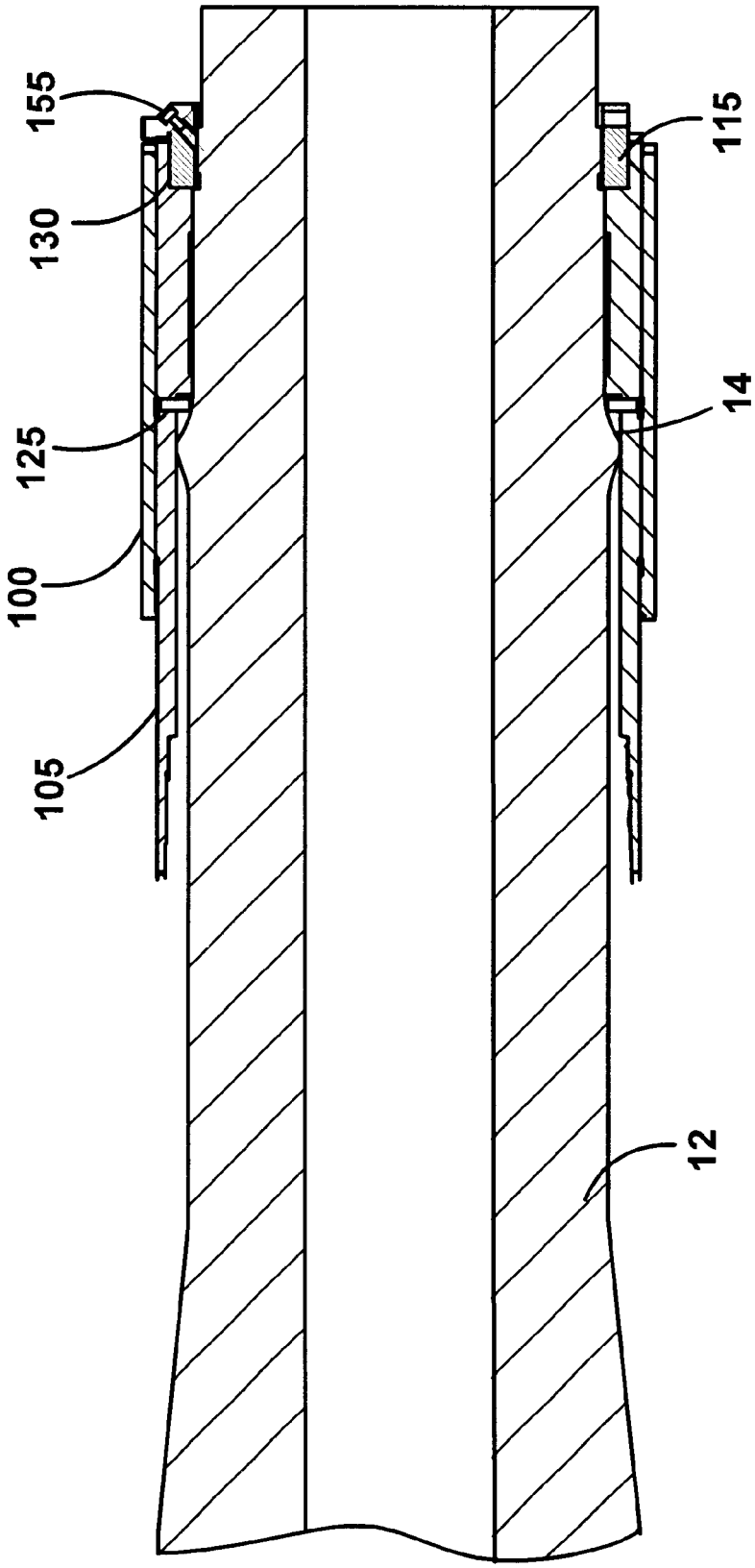
FIG. 5 is an enlarged cross-sectional, partial view of the thrust nut/bearing assembly of the interface assembly of FIG. 1, shown mounted onto the tube.

One pin 125 is then inserted into each of two radially oriented, counter-bored holes in the bearing 105. The thrust nut 100 is then threaded, holding the pins 125 in their respective holes, onto the outer diameter of the bearing 105, and forming a four-piece thrust nut/bearing assembly. The thrust nut 100 captures the pins 125 in their respective holes, preventing any subsequent motion in the outward radial direction As illustrated in FIG. 5, beginning at the muzzle end 13 of the tube 12, the thrust nut/bearing assembly is slid over the outer diameter of the tube 12 in the direction of the tube shoulder 14. The thrust nut/bearing assembly is then positioned in an axial location such that the pins 125, located in the bearing 105, seat against the tube shoulder 14, preventing any further axial motion.

The thrust nut/bearing assembly is then rotated so that the pins 125 are aligned with the notches in the tube 12. The engagement between the pins 125 and the notches in the tube 12 defines the proper angular alignment of the thrust nut/bearing assembly with respect to the tube 12. Applying an axial force, the thrust nut/bearing assembly is pushed tightly against the tube shoulder 14, maintaining the proper alignment between the pins 125 and the notches in the tube 12. The king nut 115 is then slipped over the muzzle end 13 of the tube 12 and slid forward until the threads on its inner diameter engage the threads on the outer diameter of the tube 12. The threads of the king nut 115 are tightened on the tube 12 against the bearing 105. At this point in the assembly procedure, the thrust nut 100 is still free to rotate with respect to the bearing 105.

Still with reference to FIG. 5, the king nut 115 is torqued to a specified value, and is advanced, as required, to align a keyway 116 of the king nut 115 with a corresponding notch in the bearing 105. The nut key 130 is assembled into the king nut 115 using the screw 155, thus interlocking the king nut 115 and the bearing 105, and preventing subsequent, relative or absolute axial or rotational motion of the assembly or the assembly components.

Figure 6:
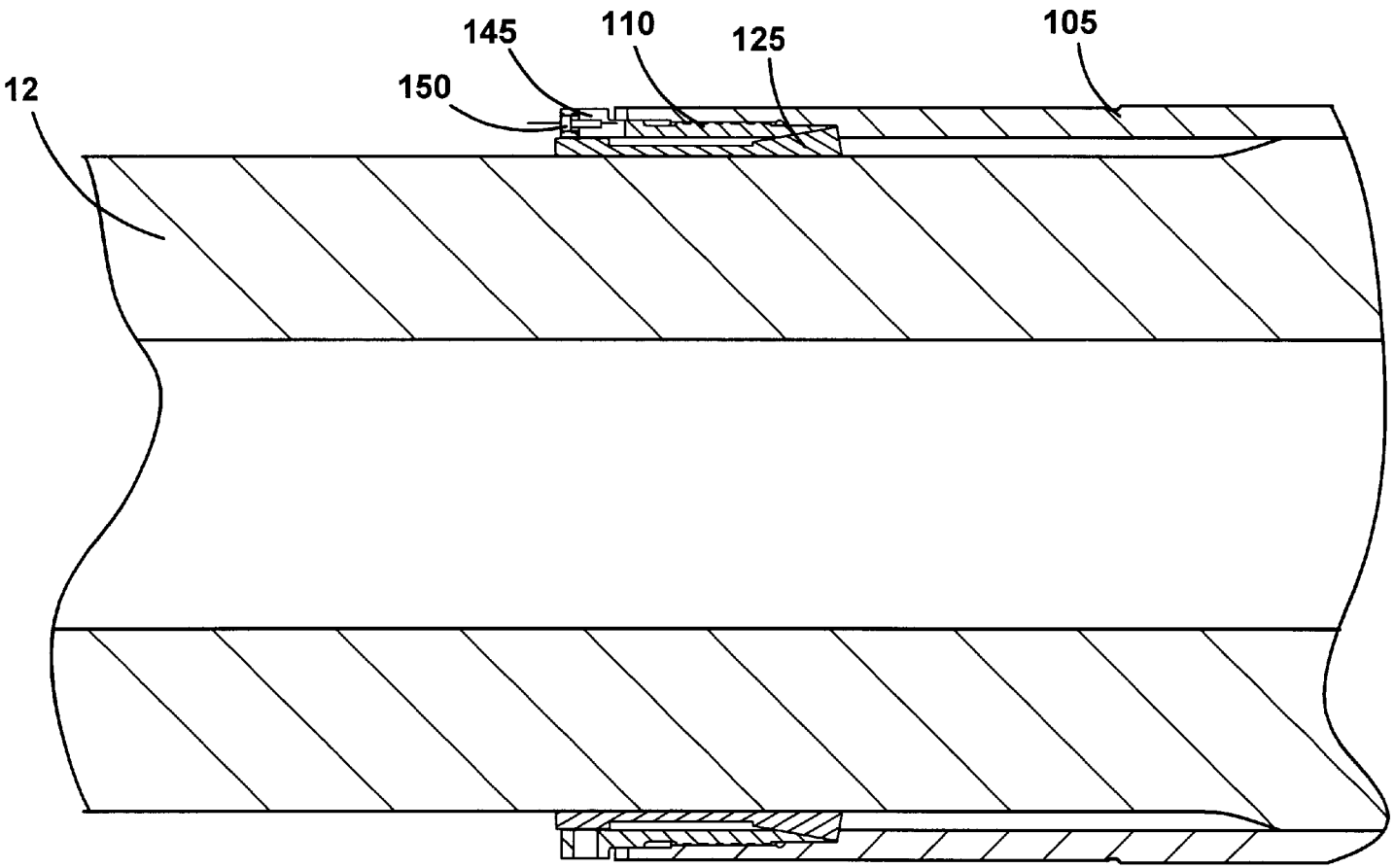
FIG. 6 is a greatly enlarged, partial, cross-sectional view of the interface assembly at an axial location on the breech side of the tube shoulder, illustrating the incorporation of the adapter, retaining ring and accompanying locking hardware into the interface assembly.

With further reference to FIG. 6, the two halves of the tapered, clam-shelled adapter 120 are positioned on either side of the outer diameter of the tube 12, forming a two-piece unit that encircles the tube 12. The tapered ends of the two pieces of the adapter 120 face the tube shoulder 14. The two halves of the adapter 120 are slid into the bore of the bearing 105, previously installed on the tube 12 as part of the thrust nut/bearing assembly.

The adapter halves is pushed forward until they seat against the internal shoulder of the bearing 105. The previously installed retaining ring 110 is then slid axially toward the tube shoulder 14, over the adapter 120, until the threads of the retaining ring 110 engage the threads of the bearing 105.

The retaining ring 110 is then threaded into the bearing 105. As the retaining ring 110 advances, a taper on the inner diameter of the retaining ring 110 engages a matching taper in the outer diameter of the adapter 120. The inner diameter of the bearing 105 impedes, and ultimately prevents the radial expansion of the retaining ring 110 as the retaining ring 110 advances into the bore of the bearing 105. Thus, continued axial advance of the adapter 120 results in the compression of the serrated fingers of the adapter 120 onto the outer diameter of the tube 12.

The tube 12 is now tightly clamped by the serrated fingers of the adapter 120, resulting in a uniformly tight, circumferential engagement between the tube 12 and the locking mechanism assembled on the outer diameter of the tube 12. Wedging action produced the relative motion of the tapered section fills the interstitial space between the inner diameter of the bearing 105 and the outer diameter of the tube 12, achieving the criterion of eliminating clearances between the bearing 105, the adapter 120 and the tube 12.

The retaining ring 110 is then torqued to a predetermined value and is advanced, as required, to align the retaining ring keyway with an adjoining notch in the bearing 105. The retaining ring key 145 is assembled into the retaining ring 110 using the pin-key 150, thus interlocking the retaining ring 110 and the bearing 105, and minimizing or preventing any subsequent relative rotational motion. The threads are staked (i.e., locked or deliberately damaged) to prevent the key retainer pin 150 from loosening. At this stage, the component parts of the interface assembly 10 are locked and interlocked, and clearances have been eliminated between the tube 12, the adapter 120, and the bearing 105, achieving is a primary criterion for the design.

Figure 7:
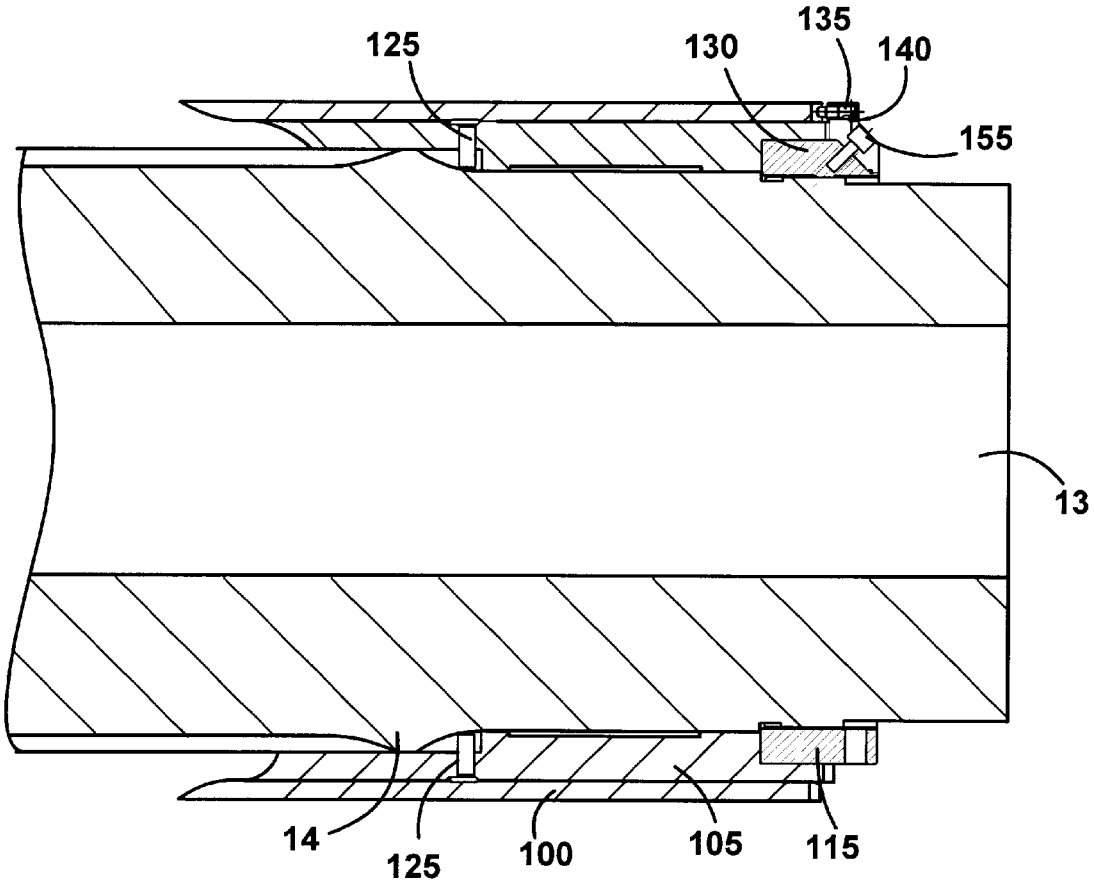
FIG. 7 is an enlarged, cross-sectional, partial view of the interface assembly, emphasizing the axial location near the muzzle of the tube, illustrating the incorporation of the locking hardware that is added to the interface assembly/gun mount assembly.

The tube 12, now fitted with the mount interface hardware, is ready for final assembly into the gun mount. The gun tube 12 is installed according to standard U.S. Army procedure TM 9-2350-264-34-2-2 (Pages 7–5 through 7–9), which is incorporated herein by reference, with the following exceptions. At step 6I (page 7–8) the, thrust nut 100 is torqued against the mount piston to a specified value of about 1000 ft-lbs, capturing the piston between the cannon breech and the thrust nut 100. The thrust nut 100 is then advanced, as required, to align a notch in the thrust nut with a locking pin hole in the previously installed nut key 130. Referring now to FIG. 7, the locking pin 135 is inserted in the nut key 130 and threaded in, until the locking pin 135 bottoms out in the thrust nut notch. The locking pin 135 is backed out one turn or less, until a recess flat on the pins is aligned with a threaded hole, and the retaining ring is then inserted. The retainer pin 140 is then inserted until it is tight. The threads of the retainer pin 140 are staked to prevent the pin from loosening.

Referring back to FIG. 2, the interface assembly 10 is now completely assembled. With all the elements of the interface assembly 10 installed, positioned, tightened and locked in place, the piston 15 is captured between the cannon breech mechanism and the thrust nut 100. All the clearances due to differences in diameter between the breech mechanism and the larger diameter barrel have been eliminated. All the components are tightening, locked, and interlocked to prevent loosening, even under high inertial loadings. A tight mount assembly has been achieved.

It should be understood that the geometry and dimensions of the components described herein may not be to scale, and may be modified within the scope of the invention. The embodiments described herein are included for the purposes of illustration, and are not intended to be the exclusive; rather, they can be modified within the scope of the invention. Other modifications may be made when implementing the invention for a particular application.

What is claimed is:

1. A locking interface assembly for adapting the tube of a Long Gun Barrel weapon, said tube comprising a shoulder on said tube, and a non-conforming outer tube diameter, to fit with an otherwise non-compatible mounting receptacle on said weapon, said locking interface assembly comprising:

a retaining ring for sliding over the tube, wherein the retaining ring includes a tapered end; and wherein the retaining ring faces a muzzle end of said tube, and;

a coupling subassembly including:

a bearing having an internal shoulder on one end thereof, said bearing including internal threads, and a thrust nut mounted on said bearing for sliding over the tube and for engaging the tube shoulder to prevent said bearing from rotating, and;

a locking mechanism for engaging the tube to capture the bearing against the tube shoulder and to prevent the bearing from moving with respect to the tube shoulder; and an adapter for engaging the internal shoulder of the bearing, said adapter having a plurality of serrated fingers and a tapered section, and wherein said adapter is fitted tightly into a bore formed in the bearing and is pressed against the tube, and further wherein the adapter includes two half sections that interfit to form an integral structure, and;

wherein the retaining ring engages the internal threads of the bearing to produce an axial motion that drives the tapered end of the retaining ring across said taper of said adapter which matches said tapered end of the retaining ring.

2. The locking interface assembly according to claim 1, wherein the tapered end of the bearing initially expands as it encounters the taper of the adapter.

3. The locking interface assembly according to claim 2, wherein the locking mechanism further includes a key retainer pin and a key retainer screw to prevent the retaining ring and the adapter from loosening by interlocking the retaining ring to the bearing.

* * * * *